US010525988B2

(12) United States Patent
Hoffman

(10) Patent No.: US 10,525,988 B2
(45) Date of Patent: Jan. 7, 2020

(54) INDUCTIVELY HEATED TANK CARS

(71) Applicant: Hydra Heating Industries, LLC, Atlanta, GA (US)

(72) Inventor: Michael Hoffman, Foley, AL (US)

(73) Assignee: HYDRA HEATING INDUSTRIES, LLC, Atlanta, GA (US)

( * ) Notice: Subject to any disclaimer, the term of this patent is extended or adjusted under 35 U.S.C. 154(b) by 676 days.

(21) Appl. No.: 15/202,186

(22) Filed: Jul. 5, 2016

(65) Prior Publication Data

US 2017/0008537 A1 Jan. 12, 2017

Related U.S. Application Data

(60) Provisional application No. 62/188,744, filed on Jul. 6, 2015, provisional application No. 62/251,765, filed on Nov. 6, 2015, provisional application No. 62/270,028, filed on Dec. 20, 2015.

(51) Int. Cl.

| | |
|---|---|
| ***B65D 88/74*** | (2006.01) |
| ***H05B 6/10*** | (2006.01) |
| ***H05B 6/36*** | (2006.01) |

(52) U.S. Cl.

CPC ..... *B61D 5/04* (2013.01); *H05B 6/108* (2013.01); *H05B 6/362* (2013.01); *H05B 2214/03* (2013.01)

(58) Field of Classification Search

CPC ..... B61D 5/04; H05B 6/362; H05B 6/108; E21B 43/34

USPC ..... 219/672, 675, 676; 105/358; 104/2

See application file for complete search history.

(56) References Cited

U.S. PATENT DOCUMENTS 3,809,846 A * 5/1974 Baumgartner ..... C30B 13/20 219/638
2002/0195019 A1* 12/2002 Woodall ..... B60P 3/2295 105/358
2012/0048801 A1* 3/2012 Hong ..... C02F 3/2853 210/603

FOREIGN PATENT DOCUMENTS

RU 2014280 * 6/1994 ..... B67D 5/00

OTHER PUBLICATIONS

Machine Translation of RU2014280, published 1994; Translated Jan. 2019 (Year: 1994).*

* cited by examiner

*Primary Examiner* — Tu B Hoang
*Assistant Examiner* — Thomas J Ward
(74) *Attorney, Agent, or Firm* — Thomas I Horstemeyer, LLP

(57) ABSTRACT

Aspects and embodiments of inductively heated tank cars are described. In one embodiment, an inductive heating system for tank cars includes a radially-curved pancake coil, a coil housing that surrounds at least a portion of the radially-curved pancake coil, and a frame structure comprising at least one attachment mechanism to secure the frame structure to an exterior surface of a tank car. The system can also include an induction heating power supply to supply power for inductively heating the tank car using the radially-curved pancake coil. When installed to the tank car, the coil housing is assembled with the frame structure to secure the radially-curved pancake coil to the exterior surface of the tank car. Any number of radially-curved pancake coils can be secured to the exterior surface of the tank car to heat the contents of the tank car through inductive heating.

14 Claims, 9 Drawing Sheets

INDUCTIVELY HEATED TANK CARS

CROSS-REFERENCE TO RELATED APPLICATIONS

This application claims the benefit of U.S. Provisional Application No. 62/188,744, filed Jul. 6, 2015, titled "Inductive Rail Tanker and Storage Tank Heating," U.S. Provisional Application No. 62/251,765, filed Nov. 5, 2015, titled "Induction Heater for Portable and Stationary Tanks," and U.S. Provisional Application No. 62/270,028, filed Dec. 20, 2015, titled "Portable Inductors for Stationary Marine Tanks and Other Uses (HYDRA+)."

BACKGROUND

Tar sands include a combination of clay, sand, water, and bitumen, which is a black viscous mixture of hydrocarbons obtained naturally or as a residue from petroleum distillation. Tar sands can be mined and processed to extract the oil-rich bitumen, and the bitumen can be refined into oil. The recovery of oil from the bitumen in tar sands requires extraction and separation systems to separate the bitumen from the clay, sand, and water that make up the tar sands. Bitumen also requires upgrading before it can be refined. Because it is so viscous, bitumen also requires dilution with lighter hydrocarbons so that it can be transported by pipelines or tank cars.

BRIEF DESCRIPTION OF THE DRAWINGS

Aspects of the present disclosure can be better understood with reference to the following drawings. It is noted that the elements in the drawings are not necessarily to scale, with emphasis instead being placed upon clearly illustrating the principles of the embodiments. In the drawings, like reference numerals designate like or corresponding, but not necessarily the same, elements throughout the several views.

DETAILED DESCRIPTION

Figure 1:
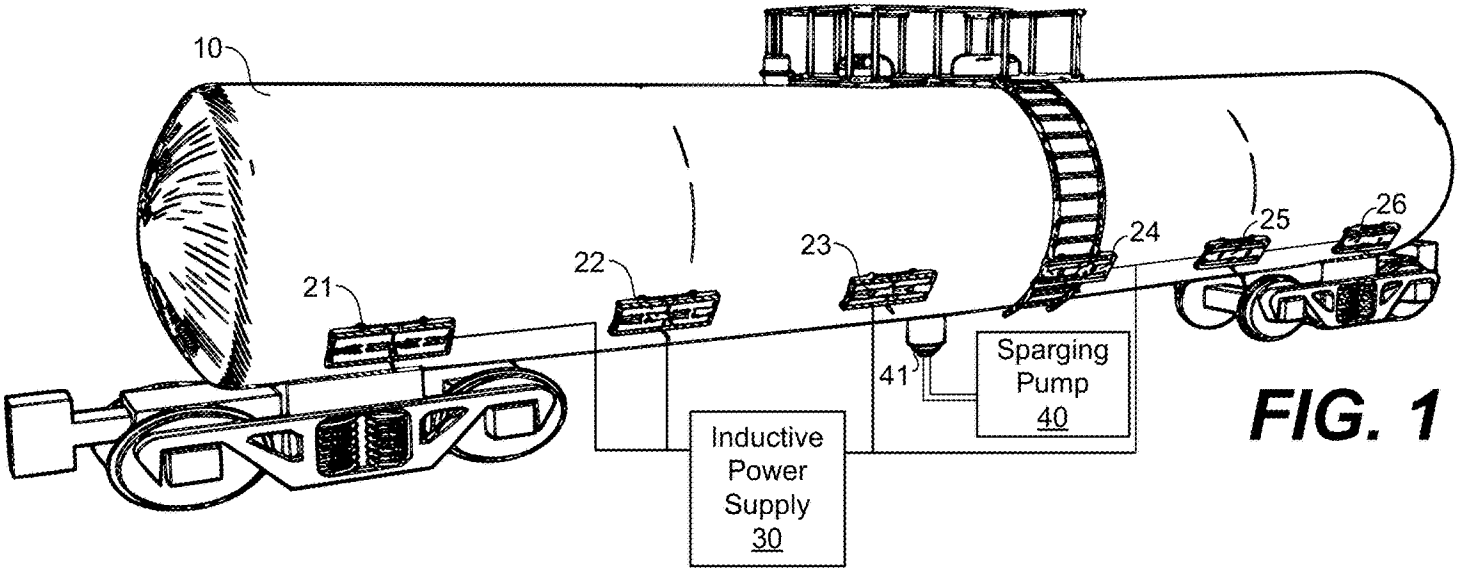
FIG. 1 illustrates a perspective view of an example tank car and inductive heating modules secured to the tank car according to one embodiment of the present disclosure.

As noted above, the recovery of oil from bitumen in tar sands requires extraction and separation systems to separate the bitumen from the clay, sand, and water in the tar sands. Because it is so viscous, bitumen typically requires dilution with lighter hydrocarbons (i.e., diluents) so that it can be more easily transported by pipelines, tank cars, etc. To create a fluid better capable of transportation, bitumen can be mixed with a fluid having a much lower viscosity, creating Dilbit. Natural gas condensate (NGC), for example, is a common diluent used to dilute bitumen into Dilbit. Once diluted into Dilbit, it can be more easily transported by pipeline, rail tank car, or other suitable means. There are other industry dilutions other than Dilbit, such as Railbit, which has less diluent than Dilbit.

A rail tank car or tank wagon is a type of railroad or railway car designed to transport liquid and/or gaseous substances. Once diluted into Dilbit, bitumen can be transported in rail tank cars. Because of the variety of different types of liquids and gases that can be transported in tank cars, different types of tank cars can be pressurized or non-pressurized, insulated or non-insulated, and designed for carrying one or several different types of substances. Depending upon the type of substance it is designed to transport, the interior of a tank car can be lined with glass or another suitable coating to isolate the contents of the tank from the shell of the tank. Tank cars carrying dangerous goods are generally made of different types of steel, depending on the intended cargo and operating pressure. Such cars can also be lined with rubber or coated with specialized coatings for the protection of the tank or to protect the purity of the product being transported.

The U.S. DOT-111 is one example of an unpressurized tank car used in North America. Tank cars built to the U.S. DOT-111 specification should be circular in cross section, having a minimum plate thickness of 7/16 inch and a maximum capacity of 34,500 US gallons. Tank cars built to the U.S. DOT-111 specification can be constructed from carbon steel, aluminum alloy, high alloy steel, nickel plate steel, or another suitable material by fusion welding. Once diluted into dilbit, bitumen can be transported in tank cars such as those built to the U.S. DOT-111 specification, among others.

It would be preferable (e.g., cheaper, safer, less time consuming, etc.), however, to transport bitumen without the need to use a diluting agent, such as NGC. To transport bitumen without a diluting agent, bitumen can be reduced in viscosity by heating. Bitumen can be heated in a variety of ways. According to aspects of the embodiments, bitumen (and/or other substances) can be heated in rail tank cars, truck tank cars, pipelines, etc., using electromagnetic induction.

An electrically conducting object (e.g., a metal) can be heated by electromagnetic fields using electromagnetic induction. Specifically, in electromagnetic induction, an electrically conducting object is heated by eddy currents induced in it by electromagnetic induction. As one example of the process of induction heating, a high-frequency alternating current (AC) can be passed through a wire or coil positioned closely to or wrapped around an electrically conducting object. A high-frequency alternating magnetic field is then generated around the wire or coil and penetrates the electrically conducting object. Due to the high-frequency alternating magnetic field, electric currents, called eddy currents, are generated inside the electrically conducting object. The eddy currents heat the electrically conducing object by the magnetic resistance inherent in the heated object.

For ferrous metals like iron and some types of steel, an additional heating mechanism beyond eddy currents occurs. Particularly, the alternating magnetic field inside the coil repeatedly magnetizes and de-magnetizes iron crystals in the electrically conducting object. This rapid flipping of the magnetic domains causes considerable friction and heating inside the object. Heating due to this mechanism is known as hysteresis loss and is greater for materials having a large area inside their magnetic flux density (B)/magnetic field strength (H) curve. Hysteresis loss can be a large contributing factor to heat generated through induction.

Using induction heating, an electrically conducing object can be directly and rapidly heated without using conduction. Because conduction is not relied upon, there is no need to make contact with the object being heated. Induction heating is used in many industrial processes, such as heat treatment in metallurgy, crystal growth in the semiconductor industry, and to melt refractory metals which require very high temperatures. Induction heating is also used in certain cooktops for cooking.

In the context outlined above, aspects and embodiments of inductively heated tank cars are described. In one embodiment, an inductive heating system for tank cars includes a radially-curved pancake coil, a coil housing that surrounds at least a portion of the radially-curved pancake coil, and a frame structure comprising at least one attachment mechanism to secure the frame structure to an exterior surface of a tank car. The system can also include an induction heating power supply to supply power for inductively heating the tank car using the radially-curved pancake coil. When installed to the tank car, the coil housing is assembled with the frame structure to secure the radially-curved pancake coil to the exterior surface of the tank car. Any number of radially-curved pancake coils can be secured to the exterior surface of the tank car to heat the contents of the tank car through inductive heating.

FIG. 1 illustrates a perspective view of an example tank car 10 and inductive heating modules 21-26 secured to the tank car 10 according to one embodiment of the present disclosure. At the outset, it is noted that the tank car 10, the inductive heating modules 21-26, and the number and arrangement of the inductive heating modules 21-26 are representative in FIG. 1. For example, while the inductive heating modules 21-26 are shown secured along an underside of the tank car 10, inductive heating modules similar to the inductive heating modules 21-26 can be secured in other locations on the tank car 10, such as along the middle of the tank car 10, along the upper side of the tank car 10, or on the ends of the tank car 10. Additionally, any suitable number of inductive heating modules can be secured to the tank car 10 among the embodiments depending upon various factors, including cost, desired heating time, etc. Further, although not shown in FIG. 1, the tank car 10 can include an additional string of inductive heating modules secured along the opposite side of the tank car 10.

The tank car 10 can be built to the U.S. DOT-111 specification, for example, or another suitable specification. The tank car 10 can be filled with and used to transport various substances. According to the examples described herein, the tank car 10 can be filled with a substance to be heated such as bitumen, and the inductive heating modules 21-26 can be used to inductively heat the tank car 10 and the substance contained in the tank car 10. Aspects of the inductive heating modules 21-26 are described in greater below with reference to FIGS. 5A-5D.

As shown in FIG. 1, an inductive power supply 30 is electrically coupled to and provides alternating current to the inductive heating modules 21-26. The inductive power supply 30 can be any power supply capable of providing sufficient electric power at a suitable alternating frequency and power level to heat the contents of the tank car 10 using the inductive heating modules 21-26. The operating frequency and power level of the inductive power supply 30 can vary based on certain factors, such as the type and size of the coils in the inductive heating modules 21-26 (examples of which are described below), the type of metallic material that the tank car 10 is formed from, the volume of the tank car 10, and the volume of the substance(s) filled in the tank car 10.

A sparging pump 40 is also shown in FIG. 1. The sparging pump 40 can be used to pump a gas into the drain 41 of the tank car 10. The gas can be selected to avoid the potential for chemical interactions with the contents of the tank car 10. Thus, an inert gas, such as nitrogen, argon, or helium, can be pumped into the tank car 10 by the sparging pump 40. In other cases, it might be suitable for the sparging pump 40 to pump air into the tank car 10. The gas pumped into the tank car 10 can help to move or mix the contents of the tank car 10 during the heating process, and it can be vented through the top of the tank car 10. However, use of the sparging pump 40 is optional among the embodiments.

As described in further detail below, the inductive heating modules 21-26 can be permanently or releasably secured to the tank car 10. Each of the inductive heating modules 21-26 can include one or more radially-curved pancake coils. When the alternating current from the inductive power supply 30 is electrically coupled to the radially-curved pancake coils, the radially-curved pancake coils generate alternating magnetic fields which induce eddy currents in the tank hull of the tank car 10. The alternating magnetic fields lead to resistive and/or hysteresis losses in the tank hull of the tank car 10, heating the tank car 10 and the contents of the tank car 10.

The alternating magnetic fields can heat the tank car 10 and the contents of the tank car 10 relatively quickly and to a relatively high temperature as compared to other conventional methods, such as using steam. The alternating magnetic fields can also be used to heat the tank car 10 and the contents of the tank car 10 to a desired temperature with relative accuracy and level or repeatability as compared to conventional methods. When heated, the contents of the tank car 10, such as bitumen, Dilbit, or Railbit, can be on-loaded and off-loaded more quickly.

Figure 2:
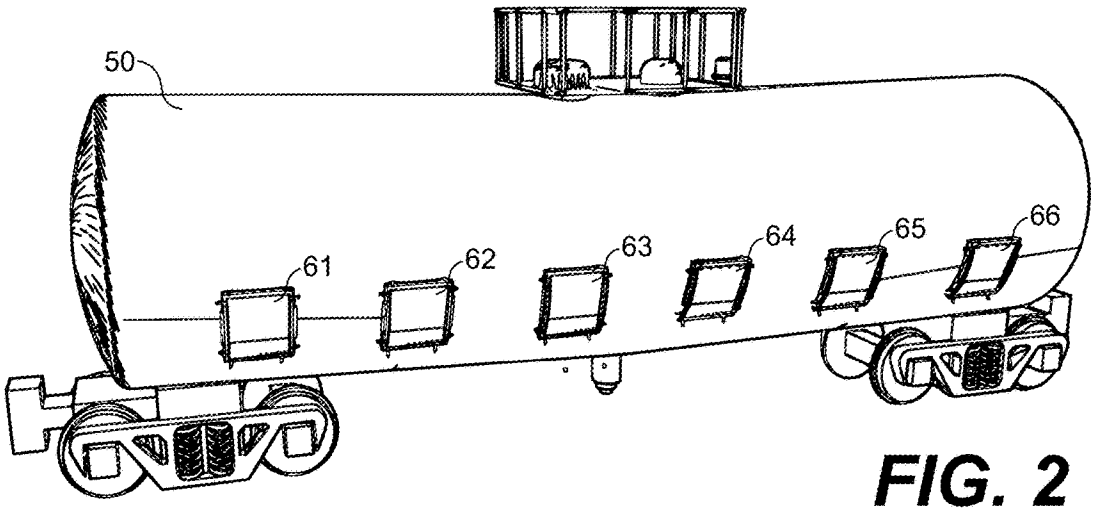
FIG. 2 illustrates a perspective view of another example tank car and another type of inductive heating modules secured to the tank car according to one embodiment of the present disclosure.

FIG. 2 illustrates a perspective view of another example tank car 50 and inductive heating modules 61-66 secured to the tank car 50 according to one embodiment of the present disclosure. Again, the tank car 50, the inductive heating modules 61-66, and the number and arrangement of the inductive heating modules 61-66 are representative in FIG. 2. For example, while the inductive heating modules 61-66 are shown secured along an underside of the tank car 50, inductive heating modules similar to the inductive heating modules 61-66 can be secured in other locations on the tank car 50, such as along the middle of the tank car 50, along the upper side of the tank car 50, or on the ends of the tank car 50. Additionally, any suitable number of inductive heating modules can be secured to the tank car 50 depending upon various factors, including cost, desired heating time, etc. Further, although not shown in FIG. 2, the tank car 50 can include an additional string of inductive heating modules secured along the opposite side of the tank car 50.

Although not shown in FIG. 2, an inductive power supply similar to the inductive power supply 30 shown in FIG. 1 can be electrically coupled to the inductive heating modules 61-66 to heat the tank car 50 and the contents of the tank car 50 through inductive heating. Similar to those shown in FIG. 1, the inductive heating modules 61-66 can be permanently or releasably secured to the tank car 50. Each of the inductive heating modules 61-66 can include one or more radially-curved pancake coils. When alternating current is electrically coupled to the radially-curved pancake coils, the radially-curved pancake coils generate alternating magnetic fields which induce eddy currents in the tank hull of the tank car 50. The alternating magnetic fields lead to resistive and/or hysteresis losses in the tank hull of the tank car 50, heating the tank car 50 and the contents of the tank car 50.

If the contents of the tank cars 10 and 50 is relatively viscous, such as the case with bitumen, the contents can be heated within the tank cars 10 and 50 using the inductive heating modules 21-26 or the inductive heating modules 61-66. In that way, it can be possible to reduce the viscosity of the contents of the tank cars 10 and 50 to a level that it can be relatively easily poured into and out of the tank cars 10 and 50. Thus, it can be possible to transport bitumen and other viscous substances without the need to use diluting agents, saving significant costs.

Figure 3A:
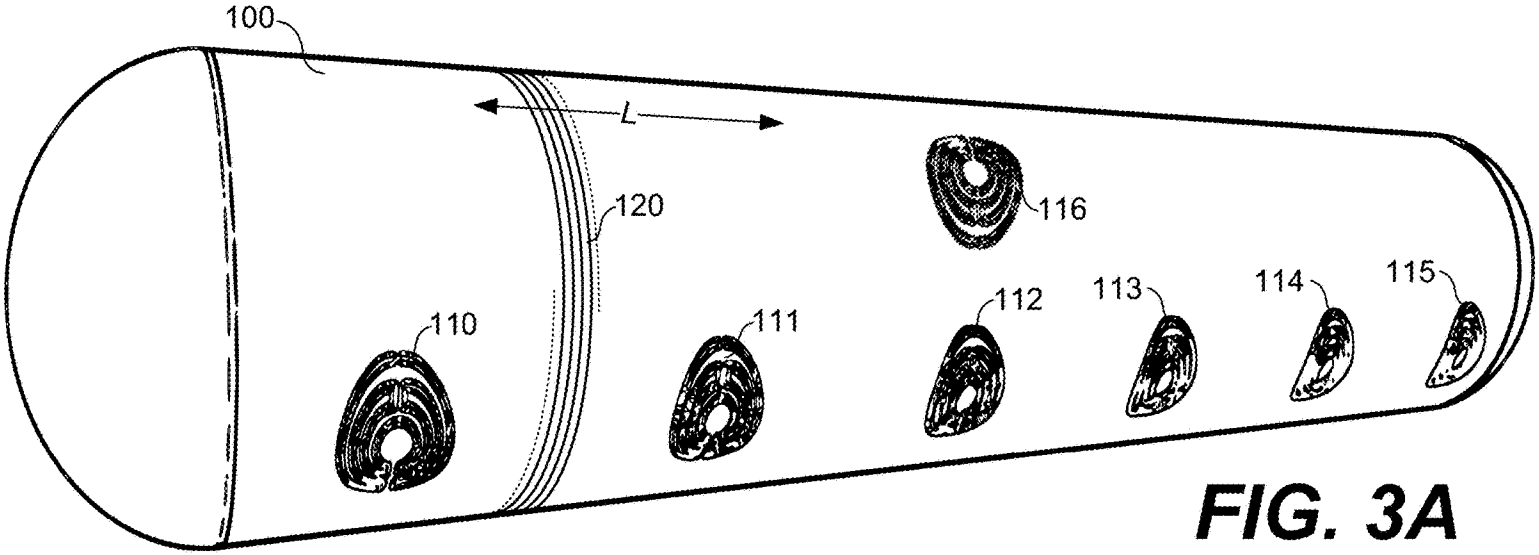
FIG. 3A illustrates a perspective view of an example tank, radially-curved pancake coils about the tank, and an axially-extending coil wrapped around the tank according to various embodiment of the present disclosure.

To further illustrate the concepts of the embodiments, FIG. 3A illustrates a perspective view of an example tank 100, radially-curved pancake coils 110-116 positioned about the tank 100, and an axially-extending coil 120 wrapped around the tank 100 according to various embodiment of the present disclosure. The radially-curved pancake coils 110-116 are shown at example locations in FIG. 3A, and a greater or lesser number of coils can be used. Additionally, while the radially-curved pancake coils 110-115 are shown along a lower or underside of the tank 100, the radially-curved pancake coil 116 is presented as an example of a coil positioned at an upper side of the tank 100.

The axially-extending coil 120 is provided an example of a coil other than a radially-curved pancake coil for inductive heating. The axially-extending coil 120 can be wrapped around the circumference of the exterior of the tank 100 and extend (e.g., wrap) about any portion of the longitudinal length L of the tank 100.

The radially-curved pancake coils 110-116 and the axially-extending coil 120, any of which can be omitted and/or repositioned, can be formed from any suitable materials for the purpose of inductive heating. In one embodiment, the coils 110-116 and/or 120 can be formed from copper wire or copper pipe, but other types of metals can be used. If formed using pipe, water or another coolant fluid can be pumped through one or more of the coils 110-116 and 120 by a water pump. In that way, the coils 110-116 and 120 can be cooled while being simultaneously used to inductively heat the tank 100. As described in further detail below with reference to FIGS. 4A-4E, the coils 110-116 can be formed in any suitable planar arrangement of wire or pipe.

Figure 3B:
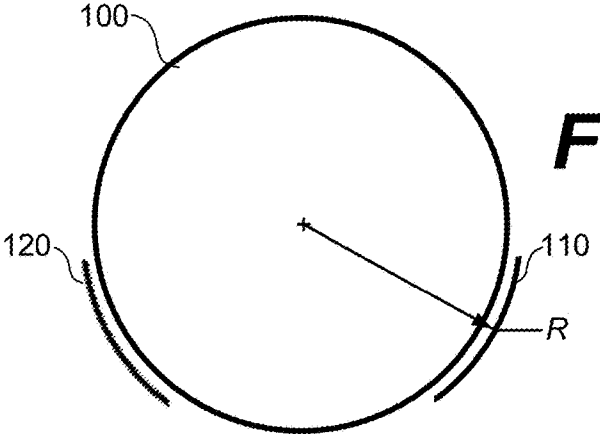
FIG. 3B illustrates a cross sectional view of the example tank and radially-curved pancake coils shown in FIG. 3A.

FIG. 3B illustrates a cross sectional view of the tank 100 and the radially-curved pancake coil 110 shown in FIG. 3A, and a cross sectional view of another radially-curved pancake coil 120. As shown in FIG. 3B, the radially-curved pancake coils 110 and 120 are formed having a radius of curvature R to conform with a curvature of the exterior surface of the tank 100 along a longitudinal length of the tank 100. In other words, the pancake coils 110 and 120, which can be formed as planar bifilar coils, for example, can be curved or bent from a substantially planar to a radially-curved shape based on the shape of the circumference of the tank 100. The radially-curved shape is used to achieve a relatively close and uniform spacing between the radially-curved pancake coils 110 (and 111-116) and 120 and the exterior surface of the tank 100.

When assembled together, the coils 110-116 and 120 can be positioned closely proximate to but with a gap or mechanical and/or electrical clearance from the exterior surface of the tank 100. To achieve that gap or clearance, the coils 110-116 and/or 120 can be insulated with plastic, rubber, or other suitable materials, encased in plastic, epoxy, or other suitable materials, or spaced-off the exterior surface of the tank 100 using bridges made of wood, plastic, etc.

Figure 4A:
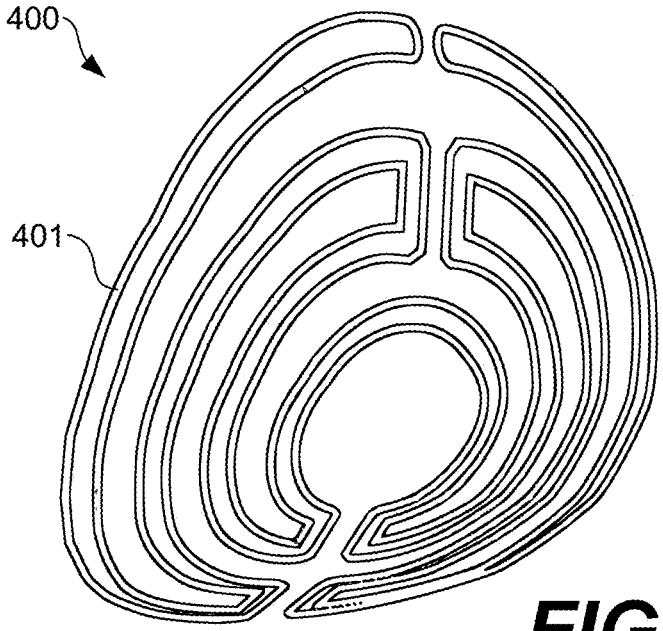
FIGS. 4A-4E illustrate various examples of radially-curved pancake coils according to the embodiments of the present disclosure.

FIGS. 4A-4E illustrate various examples of radially-curved pancake coils according to the embodiments of the present disclosure. As shown in FIG. 4A, the radially-curved pancake coil 400 is formed as a continuous circularly-arranged length of wire or pipe 401, and that structure is curved or bent to a radially-curved shape. In that form, the radially-curved pancake coil 400 can conform to (e.g., track or follow) an exterior surface of a tank, such as the tank 100 shown in FIG. 3A, for example.

Figure 4B:
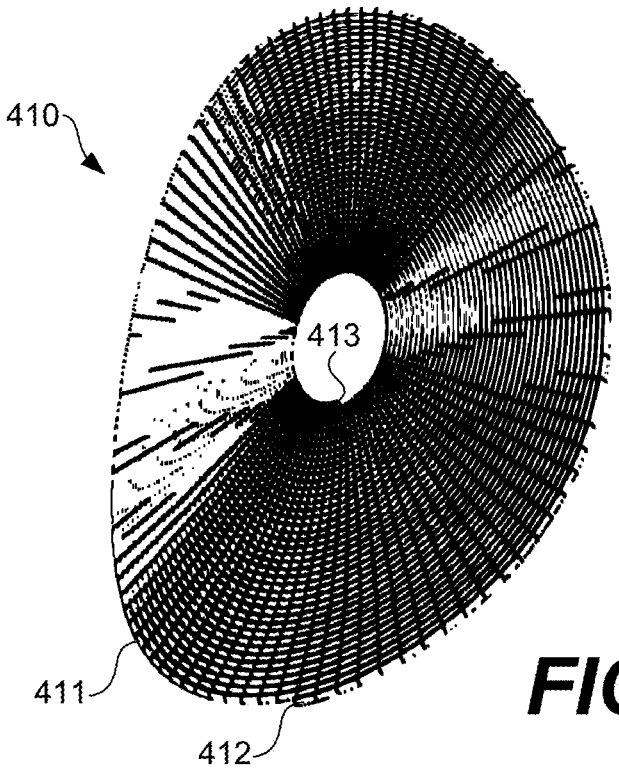

As shown in FIG. 4B, the radially-curved pancake coil 410 is formed as a continuous circularly-arranged length of wire or pipe 411, and that structure is curved or bent to a radially-curved shape. In that form, the radially-curved pancake coil 410 can conform to (e.g., track or follow) an exterior surface of a tank, such as the tank 100 shown in FIG. 3A, for example. As compared to the radially-curved pancake coil 400 shown in FIG. 4A, the radially-curved pancake coil 410 shown in FIG. 4B is continuously wound in a single circular direction. An inductive power supply can be coupled to the radially-curved pancake coil 410 between at outer contact 412 and the inner contact of the radially-curved pancake coil 410.

Figure 4C:
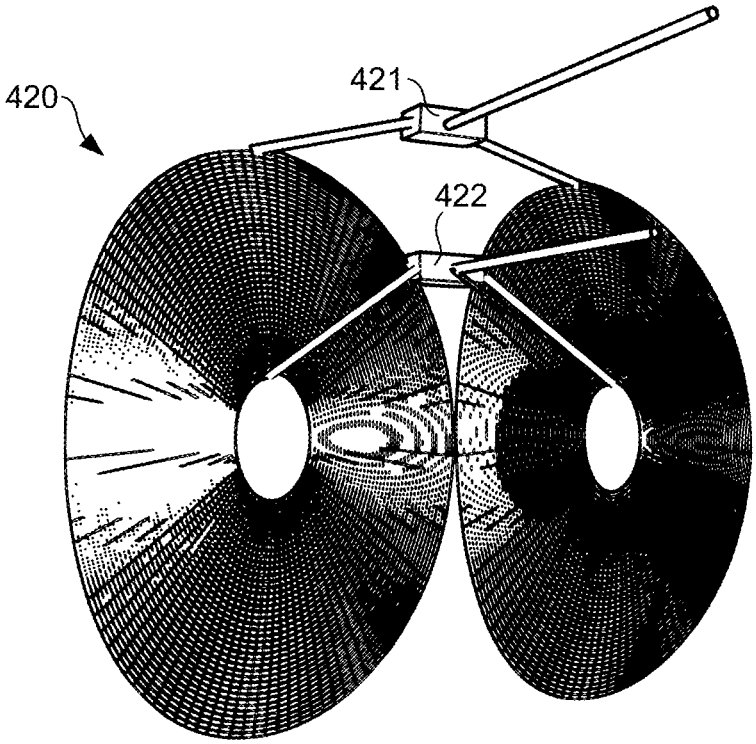

FIG. 4C illustrates a radially-curved pancake coil pair 420. The coil pair 420 can be assembled using a side-by-side pair of circularly-arranged lengths of wire or pipe similar to the radially-curved pancake coil 410 shown in FIG. 4B. The coil pair 420 can be electrically coupled, in parallel, to an inductive power supply at the electrical node blocks 421 and 422. The electrical node blocks 421 and 422 are provided by way of example in FIG. 4C, as any suitable arrangement of coupling power to the coil pair 420 can be used.

Figure 4D:
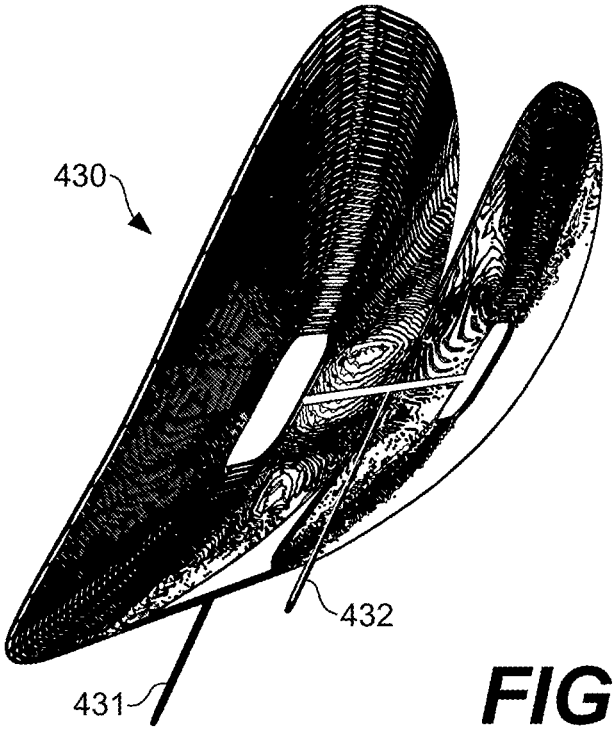

FIG. 4D illustrates another radially-curved pancake coil pair 430. The coil pair 430 can be assembled using a side-by-side pair of wound lengths of wire. Rather than extending out from a substantially circularly-shaped center, the coils in the coil pair 430 are wound around a central figure or shape more similar to a square or rectangle than a circle. The electrical nodes 431 and 432 can be provided to electrically couple the coil pair 430 to an inductive power supply.

Figure 4E:
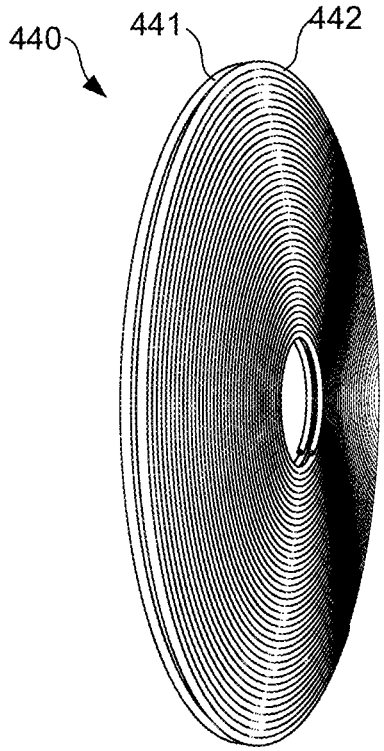

FIG. 4E illustrates another radially-curved pancake coil pair 440. The coil pair 440 can be assembled using a stacked pair of wound lengths of wire. After being stacked, the coil pair 440 can be curved or bent to a radially-curved shape similar to the radially-curved pancake coil 410 shown in FIG. 4B.

Figure 5A:
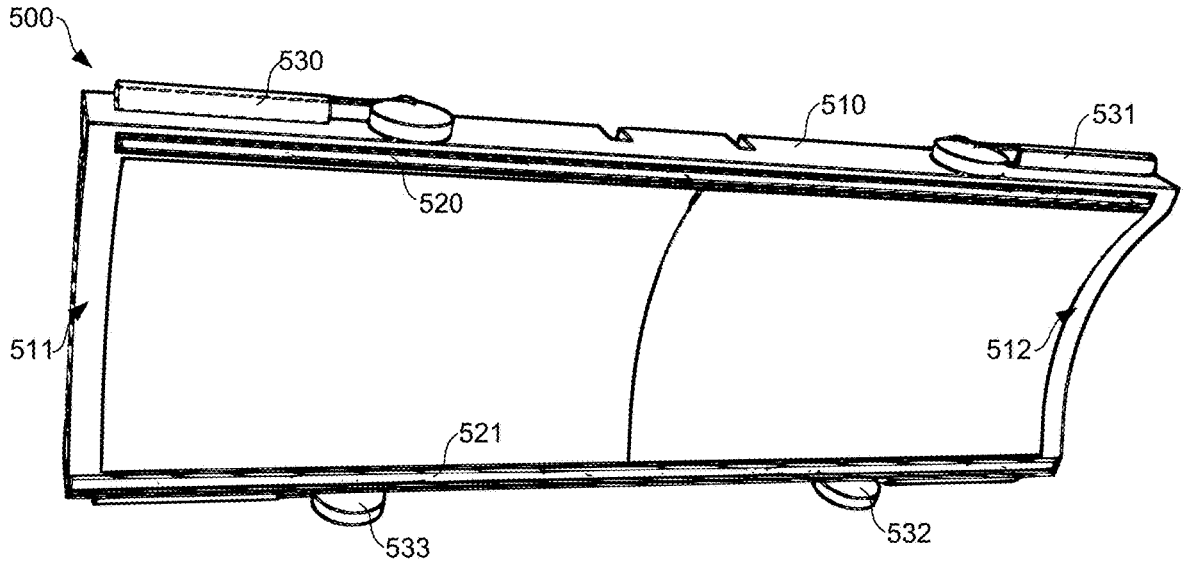
FIG. 5A illustrates a front perspective view of an example inductive heating module according to one embodiment of the present disclosure.
Figure 5B:
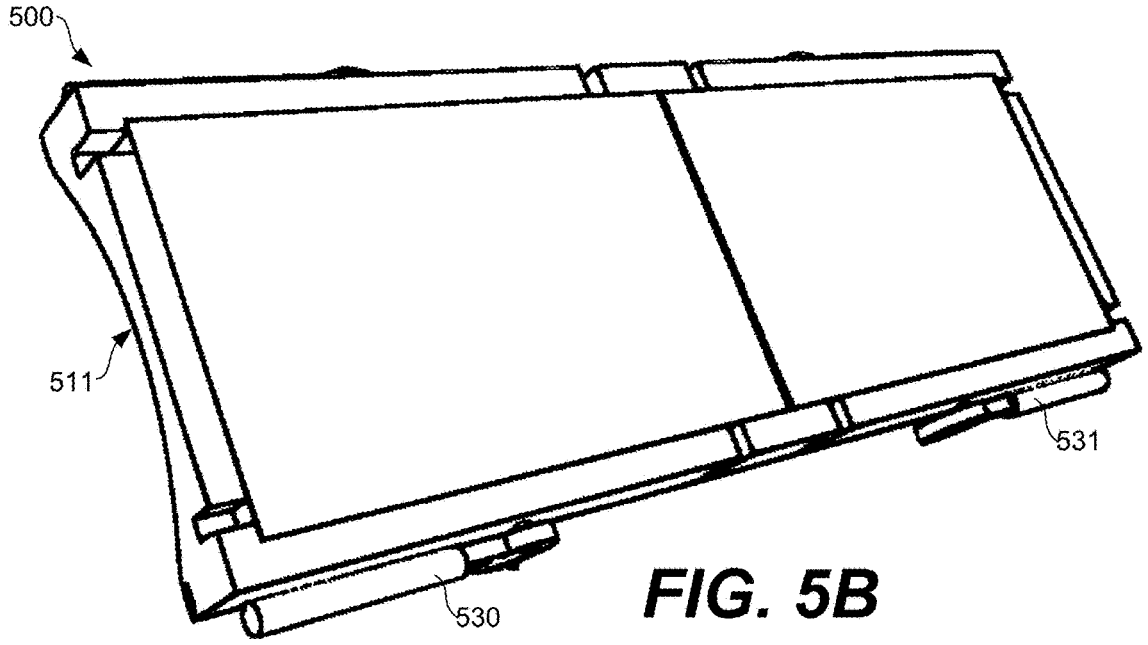
FIG. 5B illustrates a back perspective view of the inductive heating module shown in FIG. 5A according to one embodiment of the present disclosure.

FIG. 5A illustrates a front perspective view of an example inductive heating module 500, and FIG. 5B illustrates a back perspective view of the inductive heating module 500. The heating module 500 includes a frame structure 510 including curved rails 511 and 512, magnetic bars 520 and 521, and levered cam linkage assemblies 531-533 to slide the magnetic bars 520 and 521 relative to the frame structure 510. The frame structure 510 can be formed from aluminum, for example, or another suitable metal or metal alloy, or from plastic, wood, or any other suitable material.

The inductive heating module 500 is designed to be attached or secured to (and removed from) a tank car, such as the tank car 100 shown in FIG. 1, for example. In that context, the levered cam linkage assemblies 531-533 can be rotated to move or slide the magnetic bars 520 and 521 relative to the frame structure 510. In a first position of the levered cam linkage assemblies 531-533, the magnetic bars 520 and 521 are relatively more recessed into the frame structure 510. In a second position of the levered cam linkage assemblies 531-533 (e.g., the one shown in FIGS. 5A and 5B), the magnetic bars 520 and 521 are relatively less recessed into (and can potentially extend out from) the frame structure 510.

In use, the inductive heating module 500 can be placed up against the exterior surface of a tank car with the curved rails 511 and 512 facing the exterior surface. Before placing the inductive heating module 500 against the exterior surface of the tank car, the levered cam linkage assemblies 531-533 can be actuated to recess the magnetic bars 520 and 521 into the frame structure 510. Once the inductive heating module 500 is positioned at a suitable location against the exterior surface of the tank car, the levered cam linkage assemblies 531-533 can be actuated to extend the magnetic bars 520 and 521 out from (or nearly out from) the frame structure 510. In that configuration, the magnetic attraction from the magnets in the magnetic bars 520 and 521 secures the inductive heating module 500 to the external surface of the tank car, holding it in place for inductive heating. An example of inductive heating modules secured to the external surface of the tank car 100 is shown FIG. 1.

Figure 5C:
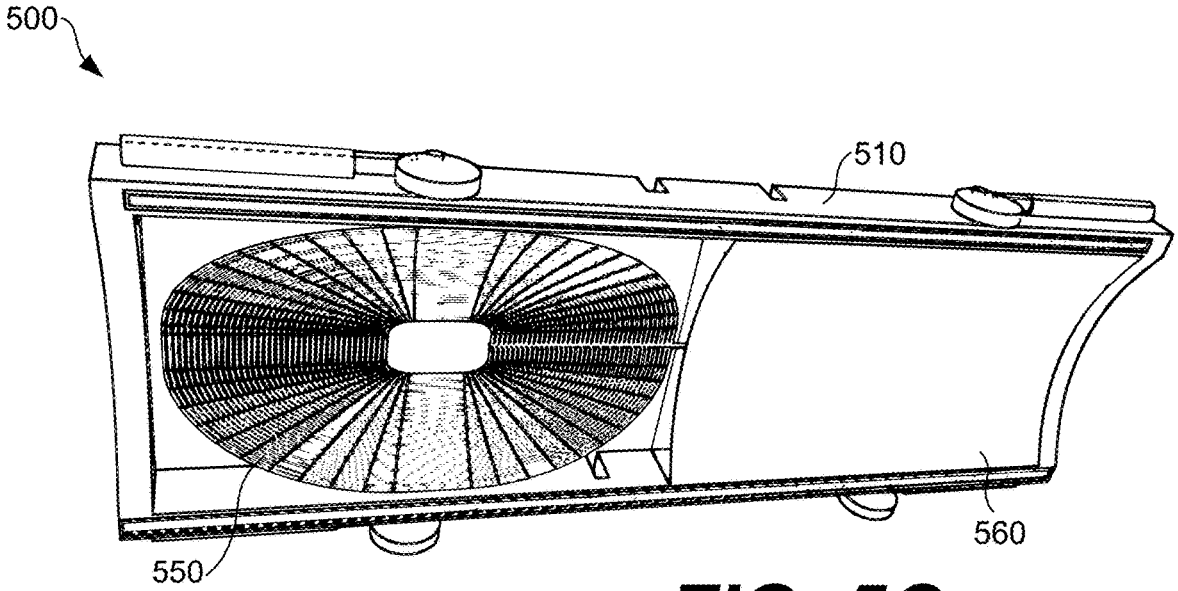
FIGS. 5C and 5D illustrate front and back perspective views of the inductive heating module shown in FIG. 5A, with the radially-curved pancake coil exposed, according to one embodiment of the present disclosure.
Figure 5D:
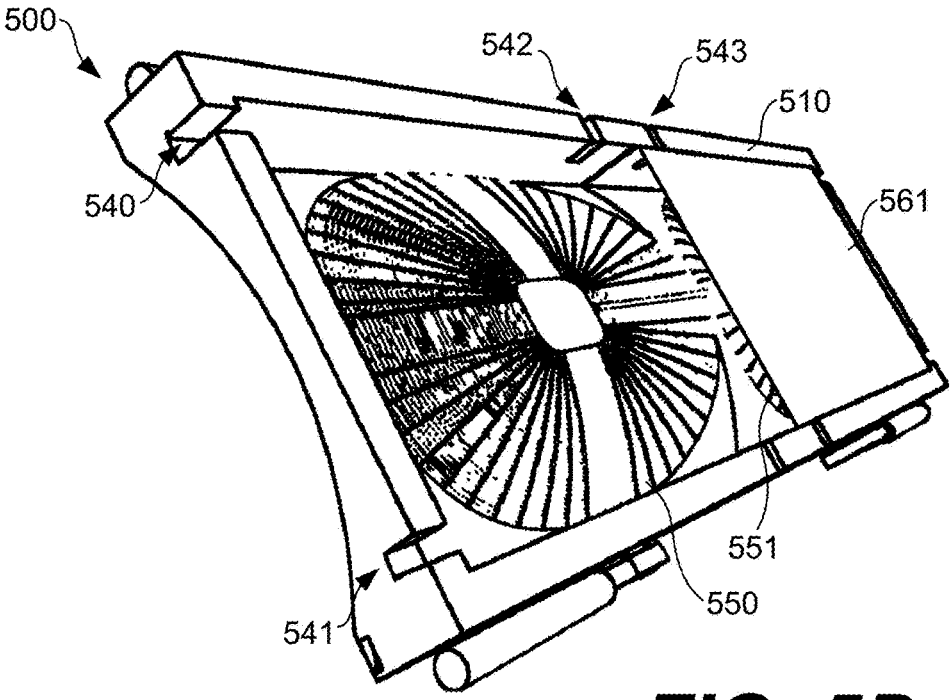

FIGS. 5C and 5D illustrate front and back perspective views of the inductive heating module 500 shown in FIG. 5A, with a radially-curved pancake coils 550 and 551 being visible within the inductive heating module 500. In FIGS. 5C and 5D, an inside panel 560 and an outside panel 561 of the inductive heating module 500 are shown around the radially-curved pancake coil 551, but the same panels are removed from view around the radially-curved pancake coil 550.

The radially-curved pancake coils 550 and 551 can be secured within the frame structure 510 in any suitable manner. To increase the efficiency of induction heating, however, the radially-curved pancake coils 550 and 551 should be secured relatively close (or as close as possible) to the inside panel 560 of the inductive heating module 500. When installed on a tank car, the inside panel 560 of the inductive heating module 500 faces the exterior surface of the tank car. Thus, the radially-curved pancake coils 550 and 551 can be secured relatively close (or as close as possible) to the inside panels of the inductive heating module 500. In that way, the radially-curved pancake coils 550 and 551 can be secured within at least a predetermined spacing to the exterior surface of the tank car to which the inductive heating module 500 is secured.

In some cases, the radially-curved pancake coils 550 and 551 can be surrounded by a coil housing, such as an epoxy or plastic-based casting. The coil housing can be seated and secured within the frame structure 510 to position the radially-curved pancake coils 550 and 551 inside the frame structure 510. In that context, the frame structure 510 and the inside and outside panels 560 and 561 can be used as a casting mold to create the coil housing surrounding the radially-curved pancake coils 550 and 551.

Although not shown in FIGS. 5C and 5D, the coil housing can include a casting that occupies the space inside the frame structure 510 around the radially-curved pancake coils 550 and 551. The coil housing can be formed so as to hold and position the radially-curved pancake coils 550 and 551 within at least a predetermined spacing to the exterior surface of the tank car to which the inductive heating module 500 is secured, similar to the location shown in FIGS. 5C and 5D.

In some cases, the frame structure 510 can include one or more coil housing seats 540-543, among others, to position and secure one or more coil housings within the frame structure 510. Additional examples of coil housing seats and the manner in which they can be used are described with reference to FIGS. 6B and 6C below.

Figure 6A:
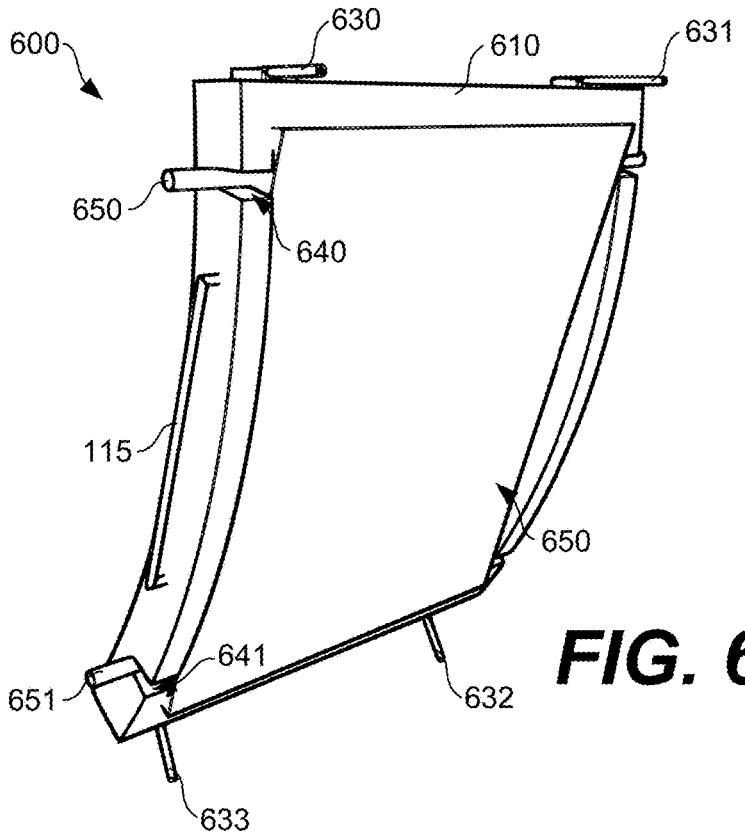
FIG. 6A illustrates a back perspective view of another example inductive heating module according to one embodiment of the present disclosure.
Figure 6B:
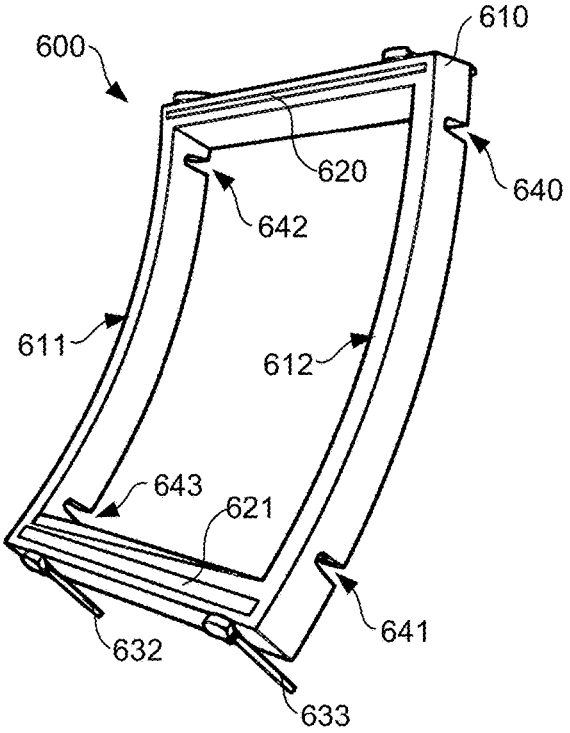
FIGS. 6B and 6C illustrate a front and back perspective views of a frame structure of the inductive heating module shown in FIG. 6A according to one embodiment of the present disclosure.
Figure 6C:
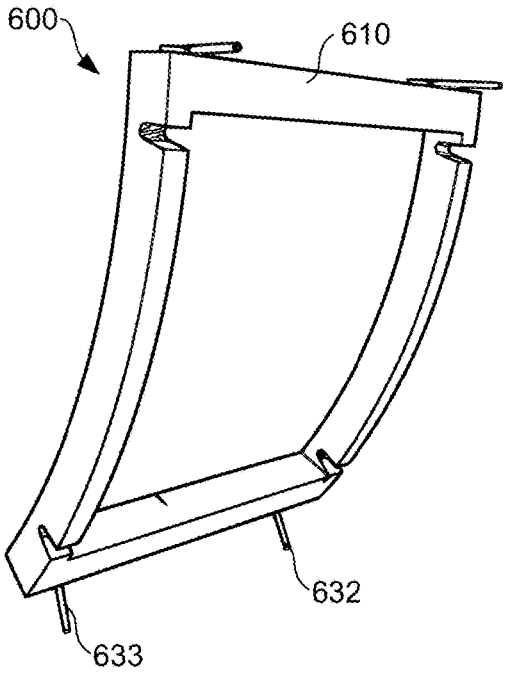

FIG. 6A illustrates a front perspective view of an example inductive heating module 600, FIG. 6B illustrates a back perspective view of a frame 610 of the inductive heating module 600, and FIG. 6C illustrates a front perspective view of the frame 610 of the inductive heating module 600. Referring among FIGS. 6A-6C, the heating module 600 includes a frame structure 610 including curved rails 611 and 612, magnetic bars 620 and 621, and levered cam linkage assemblies 631-633 to slide the magnetic bars 620 and 621 relative to the frame structure 610. The frame structure 610 can be formed from aluminum, for example, or another suitable metal or metal alloy, or from plastic, wood, or any other suitable material.

The inductive heating module 600 is designed to be attached or secured to (and removed from) a tank car, such as the tank car 100 shown in FIG. 1, for example. In that context, the levered cam linkage assemblies 631-633 can be rotated to move or slide the magnetic bars 620 and 621 relative to the frame structure 610. In a first position of the levered cam linkage assemblies 631-633 (e.g., the one shown in FIGS. 6A-6C), the magnetic bars 620 and 621 are relatively more recessed into the frame structure 610. In a second position of the levered cam linkage assemblies 631-633, the magnetic bars 620 and 621 are relatively less recessed into (and can potentially extend out from) the frame structure 610.

In use, the inductive heating module 600 can be placed up against the exterior surface of a tank car with the curved rails 611 and 612 facing the exterior surface. Before placing the inductive heating module 600 against the exterior surface of the tank car, the levered cam linkage assemblies 631-633 can be actuated to recess the magnetic bars 620 and 621 into the frame structure 610. Once the inductive heating module 600 is positioned at a suitable location against the exterior surface of the tank car, the levered cam linkage assemblies 631-633 can be actuated to extend the magnetic bars 620 and 621 out from (or nearly out from) the frame structure 610. In that configuration, the magnetic attraction from the magnets in the magnetic bars 620 and 621 secures the inductive heating module 600 to the external surface of the tank car, holding it in place for inductive heating. An example of inductive heating modules secured to the external surface of the tank car 200 is shown FIG. 2.

Radially-curved pancake coils can be secured within the frame structure 610 in any suitable manner. In the embodiment shown in FIG. 6A, a radially-curved pancake coil is surrounded by (e.g., encapsulated in) a coil housing 650. The coil housing 650 includes seating rods 650 and 651 (among others) that extend outwards from the side edges of the coil housing. The seating rods 650 and 651 can be seated and secured into the coil housing seats 640 and 641, for example, to position and secure the coil housing 650 within the frame structure 610. In some cases, the seating rods 650 and 651 can be fixed within the coil housing seats 640 and 641 using a hasp or other metal pin(s), plate(s), door(s), or mechanical interference. In other cases, the coil housing seats 640 and 641 can include notched recesses with which the seating rods 650 and 651 can be retained in a resting position due to gravity.

While the inductive heating modules 500 and 600 are described as being secured (and removed) from a tank car using magnets, the inductive heating modules 500 and 600 can be secured using other mechanisms, such as clips, pins, bolts, welds, or other suitable means.

Figure 7:
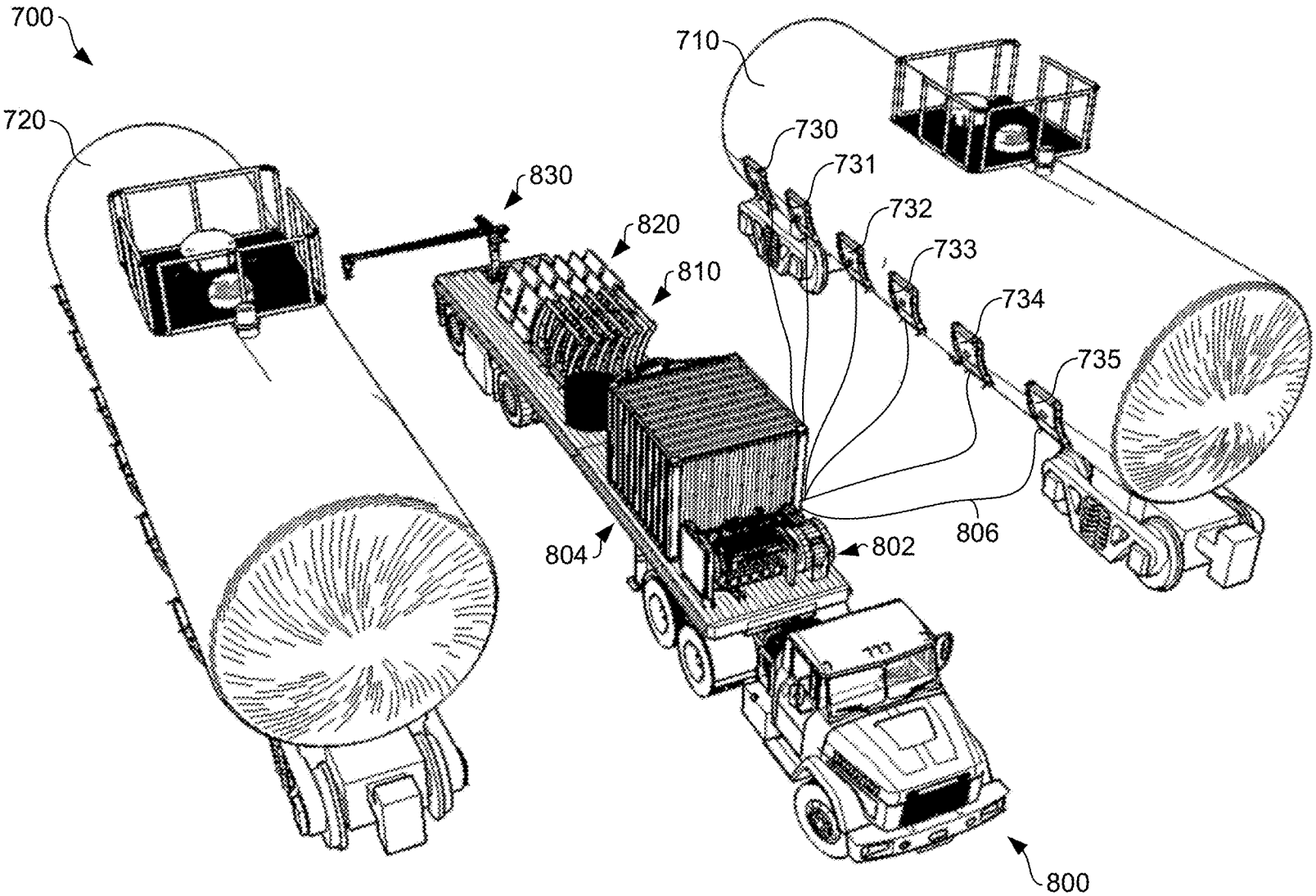
FIG. 7 illustrates an example rail tank car inductive heating system according to one embodiment of the present disclosure.

FIG. 7 illustrates an example rail tank car inductive heating system 700 according to one embodiment of the present disclosure. The system 700 includes a first tank car 710, a second tank car 720, and a mobile assembly and power source 800 for inductive heating. In the example shown, inductive heating modules 730-735, which are similar to the inductive heating modules 500 and 600 shown in FIGS. 5A-5D and 6A-6C, are installed on the first tank car 710. Similar inductive heating modules are being installed on the second tank car 720. As the system 700 is representative, one or more components can be omitted.

The mobile assembly and power source 800 can be embodied as a tractor-trailer that carries the equipment needed to install inductive heating modules, including the inductive heating modules, for example, onto the tank cars 710 and 720. The mobile assembly and power source 800 includes an electric generator 802, an inductive power supply 804, and wires or cables 806 to electrically couple alternating current from the inductive power supply 804 to the inductive heating modules 730-735 (among others). The mobile assembly and power source 800 further includes additional frame structures 810 and coil housings 820 for the assembly and installation of more inductive heating modules, for example, on the tank car 720. The crane 830 can be used, if necessary, to support the frame structures 810 against the tank car 720 while they are being secured to the tank car 720. Once the frame structures 810 are secured, the crane 830 can also be used to lift the coil housings 820 into the secured frame structures 810. Afterwards, the wires or cables 806 can be connected for inductive heating.

Although rail tank cars are shown in FIGS. 1, 2 and 7, the inductive heating modules described herein can be installed on truck tank cars for transportation on surface streets. Additionally, although FIG. 7 illustrates a system 700 in which the tank cars 710 and 720 can be heated in a stationary condition using power generated onboard the mobile assembly and power source 800, inductive power sources or supplies can be provided on the tank cars 710 and 720. For example, a generator can be mechanically coupled to the wheels of a tank car and used to generate power to supply inductive heating modules on the tank car while it is moving. In that way, the contents of the rail car can arrive in a heated state.

Although embodiments have been described herein in detail, the descriptions are by way of example. The features of the embodiments described herein are representative and, in alternative embodiments, certain features and elements may be added or omitted. Additionally, modifications to aspects of the embodiments described herein may be made by those skilled in the art without departing from the spirit and scope of the present invention defined in the following claims, the scope of which are to be accorded the broadest interpretation so as to encompass modifications and equivalent structures.

Therefore, at least the following is claimed:

1. An inductive heating system, comprising:
a tank car;
a radially-curved pancake coil secured to an exterior surface of the tank car; and
an induction heating power supply electrically coupled to the radially-curved pancake coil to supply power for inductively heating the tank car using the radially-curved pancake coil;
a removable frame structure comprising at least one attachment mechanism to secure the removable frame structure to the exterior surface of the tank car; and
the attachment mechanism comprising at least one magnetic bar and a levered cam linkage assembly to slide the at least one magnetic bar relative to the removable frame structure.

2. The inductive heating system of claim 1, further comprising a coil housing that surrounds at least a portion of the radially-curved pancake coil.

3. The inductive heating system of claim 2, wherein the coil housing is assembled with the removable frame structure to secure the radially-curved pancake coil within at least a predetermined spacing to the exterior surface of the tank car.

4. The inductive heating system of claim 2, wherein:
the removable frame structure includes a plurality of coil housing seats; and
the coil housing is seated into the removable frame structure using the plurality of coil housing seats.

5. The inductive heating system of claim 1, wherein the at least one magnetic bar relative is relatively more recessed into the removable frame structure in a first position of the levered cam linkage assembly, and the at least one magnetic bar relative is relatively less recessed into the removable frame structure in a second position of the levered cam linkage assembly.

6. The inductive heating system of claim 1, wherein the radially-curved pancake coil is formed having a radius of curvature to conform with a curvature of the exterior surface of the tank car along a longitudinal length of the tank car.

7. The inductive heating system of claim 1, wherein the radially-curved pancake coil comprises a plurality of radially-curved pancake coils secured to an exterior surface of the tank car.

8. The inductive heating system of claim 1, further comprising a sparging pump to pump a gas into a drain of the tank car while inductively heating the tank car using the radially-curved pancake coil.

9. An inductive heating system, comprising:
a radially-curved pancake coil;
a coil housing that surrounds at least a portion of the radially-curved pancake coil; and
a frame structure comprising at least one attachment mechanism to secure the frame structure to an exterior surface of a tank car, wherein the coil housing is assembled with the frame structure to secure the radially-curved pancake coil to the exterior surface of the tank car; and
the attachment mechanism comprising at least one magnetic bar and a levered cam linkage assembly to slide the at least one magnetic bar relative to the frame structure.

10. The inductive heating system of claim 9, further comprising an induction heating power supply electrically coupled to the radially-curved pancake coil to supply power for inductively heating the tank car using the radially-curved pancake coil.

11. The inductive heating system of claim 9, wherein:

the frame structure includes a plurality of coil housing seats; and the coil housing is seated into the frame structure using the plurality of coil housing seats.

12. The inductive heating system of claim 9, wherein the at least one magnetic bar relative is relatively more recessed into the frame structure in a first position of the levered cam linkage assembly, and the at least one magnetic bar relative is relatively less recessed into the frame structure in a second position of the levered cam linkage assembly.

13. The inductive heating system of claim 9, wherein the radially-curved pancake coil is formed having a radius of curvature to conform with a curvature of the exterior surface of the tank car along a longitudinal length of the tank car.

14. The inductive heating system of claim 9, wherein the radially-curved pancake coil comprises a plurality of radially-curved pancake coils secured to an exterior surface of the tank car.

* * * * *